United States Patent [19]

Griffith

[11] 4,314,300

[45] Feb. 2, 1982

[54] FUSED SHORT CIRCUIT AND GROUNDING SWITCH

[76] Inventor: Charles E. Griffith, 11212 Whisperwood La., Rockville, Md. 20852

[21] Appl. No.: 92,884

[22] Filed: Nov. 9, 1979

[51] Int. Cl.[3] ..... H01H 19/10; H01H 75/02

[52] U.S. Cl. ..... 361/13; 361/104

[58] Field of Search ..... 361/8, 13, 55, 57, 104

[56] References Cited

U.S. PATENT DOCUMENTS 3,309,478 3/1967 Kiesel et al. ..... 361/104 X 3,395,316 7/1968 Denes et al. ..... 361/13 X

*Primary Examiner*—Patrick R. Salce

*Assistant Examiner*—Reinhard J. Eisenzopf

*Attorney, Agent, or Firm*—Beveridge, DeGrandi, Kline & Lunsford

[57] ABSTRACT

A fused short circuit and grounding switch for interconnection in a main circuit, the switch having a switch member operable in one position thereof as a part of the main circuit and operable in another position out of and breaking the normal continuity of the main circuit therethrough and to provide a solid bolted fault, and including an alternate circuit interconnected to and operable to be in parallel with the main circuit, the alternate circuit being fused, the switch being operable to short circuit the alternate circuit and clear the fusing thereof and to thereby interrupt the main circuit on operation of the switch member to the position thereof providing a solid bolted fault.

23 Claims, 6 Drawing Figures

FUSED SHORT CIRCUIT AND GROUNDING SWITCH

BRIEF BACKGROUND, FIELD AND OBJECTIVES OF THE INVENTION

This invention relates to an improved fused short circuit and grounding switch which is operable to clear low current arcing faults on high current high capacity electrical circuits, such as in protecting 480Y/277 volt electric service.

Historically, overcurrent protection on power systems has been designed to sense and clear so-called "bolted faults" in which the fault impedance is assumed to be zero. Such faults produce maximum fault currents that are easily distinguished from load and inrush currents, and overcurrent protective devices now in use are generally adequate for this purpose. On the other hand, sensing and clearing low current arcing faults, particularly on 480Y/277 volt service, has proven extremely difficult. For instance, although ground fault circuit interrupters now available respond to low current arcing faults on branch circuits, in a manner which complies with code requirements, they are not now generally used in the mains, since they inherently lack the required selectivity for coordination to prevent the unnecessary and undesirable tripping of tandemly connected ground fault circuit interrupter equipped devices.

Although the magnitude of the current in an arcing fault may be much less than in a bolted fault, arcing faults can be much more destructive, because they release tremendous energy concentrated at the fault location. In contrast, dissipation of the energy of a bolted fault is distributed throughout the system resistance on the source side of the fault.

Low current arcing faults may occur anywhere on a 480Y/277 volt system, and my fused short circuit and grounding switch may be employed at various locations therein as may be desired. However, the same most usually occur in the customer's equipment, such as the customer's main switchboard. Such faults can be initiated by a variety of causes, including inadvertently allowing fish tapes to enter equipment with bare buses, slippage of electricians' tools, loose connections, rodents, insulation contamination and deterioration, heat cycling, voltage surges, and mechanical effects of current surges. When a low current arcing fault occurs in the customer's switchboard, the load side thereof is not protected by the overcurrent type circuit breakers of the switchboard, and the line side thereof is now totally unprotected. Thus, when a low current arcing fault occurs in a customer's switchboard, it is not at all unusual for the entire switchboard to be destroyed.

Low current arcing faults also frequently occur in network protectors, in which case the network protector is likely to be destroyed, and other equipment interconnected therewith, such as a transformer, extensively damaged.

The problem of sensing and clearing low current arcing faults is presently sought to be resolved by two basic methods: opening of low-voltage network protectors, and high-voltage circuit interrupters. The disadvantage of using a low-voltage network protector is that the same may not sense and clear the fault if the fault occurs in the protector, and high-voltage circuit interrupters are too costly to use on all 480Y/277 volt services.

It is accordingly a primary object of this invention to provide a reliable and economically feasible fused short circuit and grounding switch for sensing and clearing low current arcing faults which may occur in such as a 480Y/277 volt service. Of course, my switch may be used in other than 480Y/277 volt services, and may be useful other than in sensing and clearing low current arcing faults, and use thereof is not limited to such purposes, such use thereof being set forth herein since my switch was principally developed for such purposes and as illustrative of an example of the usefulness thereof.

A further object of the invention is the provision of a fused short circuit and grounding switch having a high interrupting capability with a minimum of arcing; which may be incapsulated to be submersible, explosion proof, and effectively sealed against dust, moisting, rodents, or accidental contact with parts or material which could cause arcing and render the same ineffective; and which may be located remote from the device to be protected, a sensor being provided for the device to be protected and interconnected to my switch for selective operation thereof when a condition is created or exists in the device or area to be protected which calls for operation of my improved switch. In this regard, present code requirements limit the quantity and location of main switches, for the convenience of fire fighters. By providing relatively inexpensive, unrestricted, multiple remote tripping sensors, low current arcing fault protection is provided by such as thermal sensors in the switchboard, ground fault circuit interrupter protection can be provided by auxiliary relays, and fire fighter protection can be provided by a suitable manually operated emergency toggle switch in the building lobby. It would also be practicable to interconnect automatic sprinkler and alarm systems with the sensor circuit.

Other objects and advantages of the invention will become apparent from the following detailed description, taken in connection with the accompanying drawings, and in which drawings:

DETAILED DESCRIPTION

Figure 1:
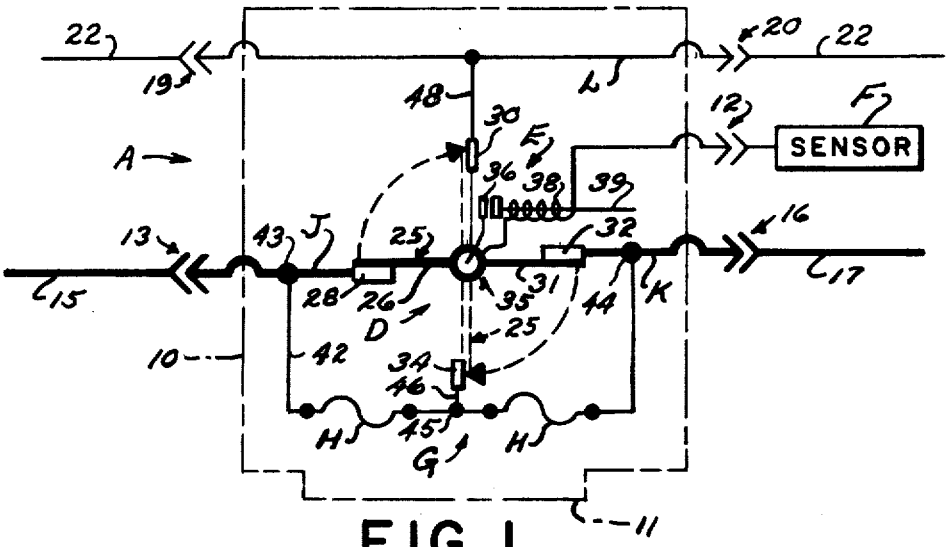
FIG. 1 is a schematic diagram of one form of my fused short circuit and grounding switch.
Figure 2:
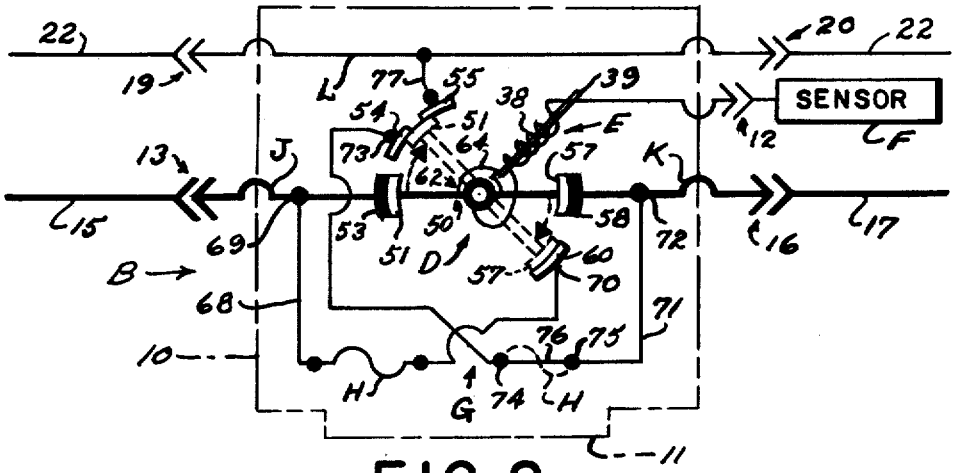
FIG. 2 is a schematic diagram of another form thereof.
Figure 3:
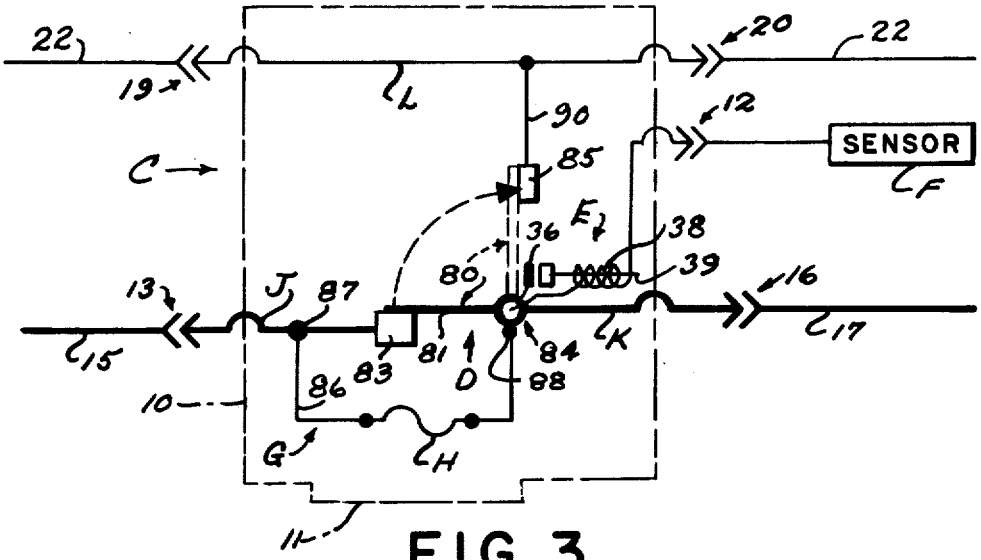
FIG. 3 is a schematic diagram of another form thereof.
Figure 4:
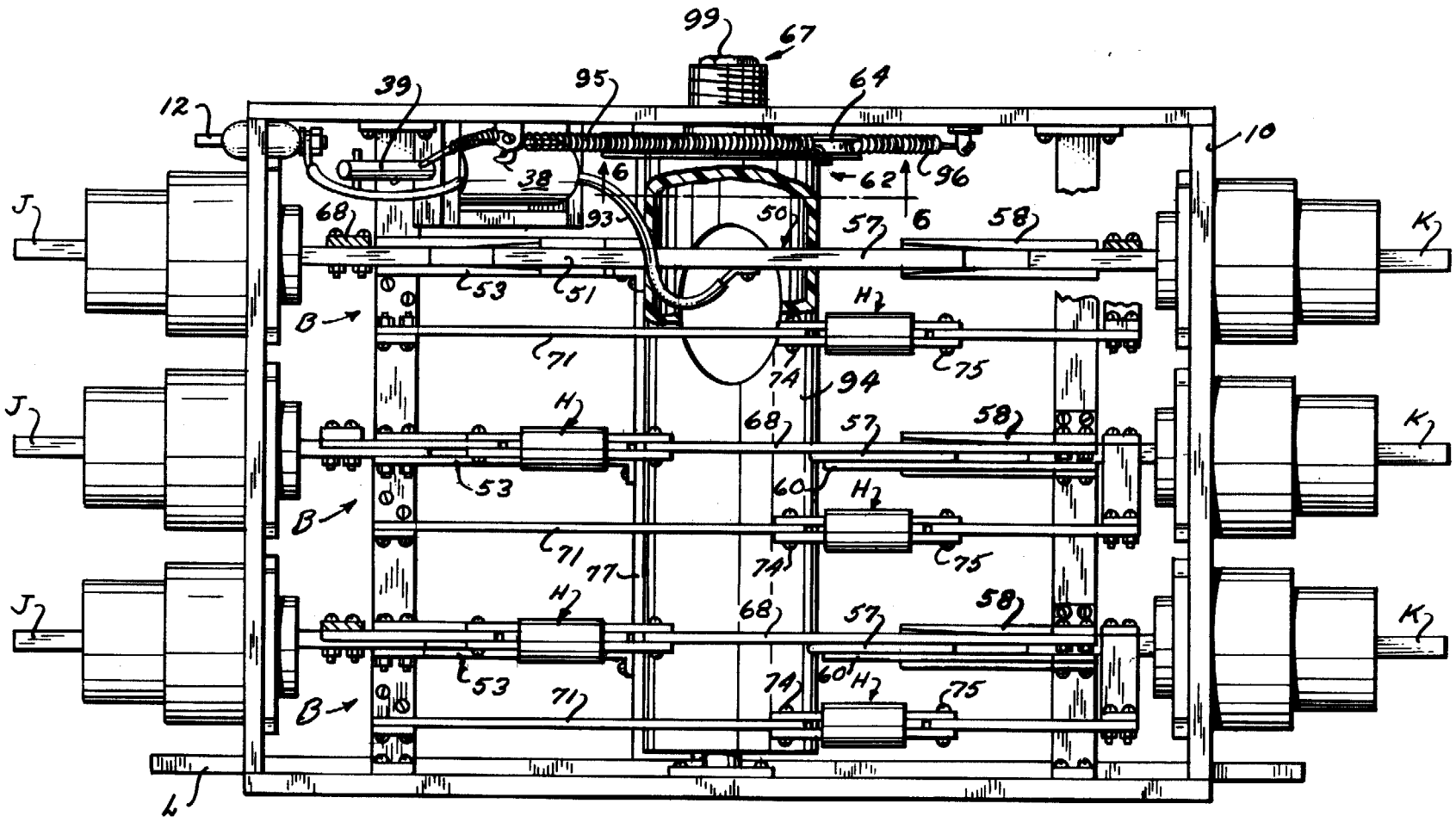
FIG. 4 is a top plan view of a switch for a three-phase circuit which is operable in accordance with the schematic shown in FIG. 2.

In the drawings, wherein similar reference characters designate corresponding parts throughout the several views, and wherein are shown various embodiments of the invention, the letter A may generally designate the fused short circuit and grounding switch as shown in FIG. 1; B the switch as shown in FIG. 2; and C the switch as shown in FIG. 3. In the case of multiple phase circuits, there may be a switch provided for each phase, FIG. 4 showing switch B as used in a three-phase circuit.

Certain elements are common to all forms of the invention herein shown and described. That is, each switch A, B and C may include switch means D, actuating means E for operation of switch means D, such as by sensor means F, alternate circuit means G having fuse means H therein, conductor means J interconnectable to an LVAC network main such as a line phase conductor, conductor means K interconnectable to an LVAC network main such as a load phase conductor, and conductor means L interconnectable to a neutral bus.

Also, each switch A, B and C may be encapsulated within a housing 10, provided with a sealed access door 11, and have connector means 12 for interconnection of actuating means E to sensor means F, connector means 13 for interconnection of conductor means J to such as line phase conductor 15, connector means 16 for interconnection of conductor means K to such as load phase conductor 17, and connector means 19 and 20 for interconnection of conductor means L to a neutral bus 22.

SCHEMATIC OF FIG. 1

As shown in FIG. 1, switch means D may include a switch arm 25 having a switch arm contact 26 engageable with switch arm contact 28 of conductor means J and switch arm contact 30; and a switch arm contact 31 engageable with switch arm contact 32 of conductor K and switch arm contact 34. Mounting means 35 is provided for supporting switch arm 25 for pivotal movement from the position thereof as shown in full lines to the position thereof as shown in dotted lines. Mounting means 35 may include positioning means (not shown) for maintaining switch arm 25 as a part of and for the continuity of the main circuit (the full line showing of switch arm 25), having a trip means 36 for release of switch arm 25 out of and breaking the normal continuity of the main circuit therethrough, and movement thereof to engage switch arm contacts 30 and 34 (the dotted line showing of switch arm 25).

Actuating means E may comprise a solenoid 38 having a plunger 39 operable to engage trip means 36 for release of switch arm 25. In addition to being electrically operable, plunger 39 may be sufficiently elongate to extend exteriorly of housing 10 (as will be subsequently described in connection with the embodiment of FIGS. 4–6) so that actuating means E may be manually operated to engage trip means 36 for release of switch arm 25. Also, mounting means 35 may be provided with manually operable switch arm reset means (again as will be subsequently described in connection with the embodiment of FIGS. 4–6) for movement of switch arm 25 out of engagement with switch arm contacts 30 and 34 and back into engagement with switch arm contacts 28 and 32 (the full line showing of switch arm 25).

Sensor means F may comprise any conventional detection system for sensing low current arcing faults, and will be juxtaposed within or adjacent to the device to be protected, such as a switchboard, in a manner to sense a low current arcing fault thereof. Heat detection systems as conventionally used to sense such low current arcing faults and sensor means F may thus comprise a thermally sensitive sensor such as a eutectic device.

Alternate circuit means G preferably includes conductor means 42 having one terminal 43 thereof attached to conductor means J, and thereby being engageable in circuit with switch arm 25 when switch arm 25 forms a part of the main circuit, another terminal 44 attached to conductor K, and thereby being engageable in circuit with switch arm 25 when switch arm 25 forms a part of the main circuit, and an intermediate terminal 45 having conductor means 46 interconnected to switch arm contact 34. Alternate circuit means G is thus parallel with the main circuit.

Conductor means 42 may be provided with a fuse means H intermediate terminals 43 and 45 thereof and intermediate terminals 44 and 45 thereof. As so designed, switch A may be used as a network isolating switch and for protecting both the load and line side of the main circuit. If just the line side of the main circuit is to be protected, only a single fuse means H need be used intermediate terminals 43 and 45 of and, if just the load side of the main circuit is to be protected, only a single fuse means H need be used, intermediate terminals 44 and 45. However, in order to eliminate the necessity of stockpiling a variety of such switches, and thereby incurring the possibility that the wrong type will be selected, it is believed most practical that alternate circuit means G have two fuse means H, as shown and described.

Fuse means H preferably comprise high capacity fuses such as to clear and interrupt alternate circuit means G before the current therethrough reaches a peak cycle. Since fuse means H are normally shunted by the main circuit, no fuse energy losses are incurred and a smaller, less expensive fuse can be used than if it were a part of the main circuit.

Conductor means 48 interconnects switch arm contact 30 to conductor means L, thereby providing a solid bolted fault of switch means D when switch arm contact 26 thereof engages switch arm contact 30.

In operation, switch means D is operable as a part of and for the normal continuity of the main circuit, as shown in heavy lines. When sensor F senses a low current arcing fault in the device to be protected, solenoid 38 is operated thereby to engage trip means 36 (or plunger 39 may be manually pushed in to engage trip means 36 in manual operation of switch A), mounting means 35 releases switch arm contacts 26 and 31 of switch arm 25 from engagement with switch arm contacts 28 and 32 and urges the same into respective engagement with switch arm contacts 30 and 34. It is to be particularly noted that if alternate circuit means G was not in parallel with the main circuit, appreciable arcing would occur as switch arm contacts 26 and 31 leave engagement with switch arm contacts 28 and 32, such as to perhaps render switch A inoperable. Thus, the provision of alternate circuit means G in parallel with the main circuit is an important feature in dampening any arcing in the main circuit when the normal continuity thereof is broken.

When switch contacts 26 and 31 of switch arm 25 engage switch arm contacts 30 and 34, as shown in dotted lines, a solid bolted fault is provided which short circuits alternate circuit means G, clears fuse means H thereof, and thereby interrupts the main circuit.

SCHEMATIC OF FIG. 2

Figure 6:
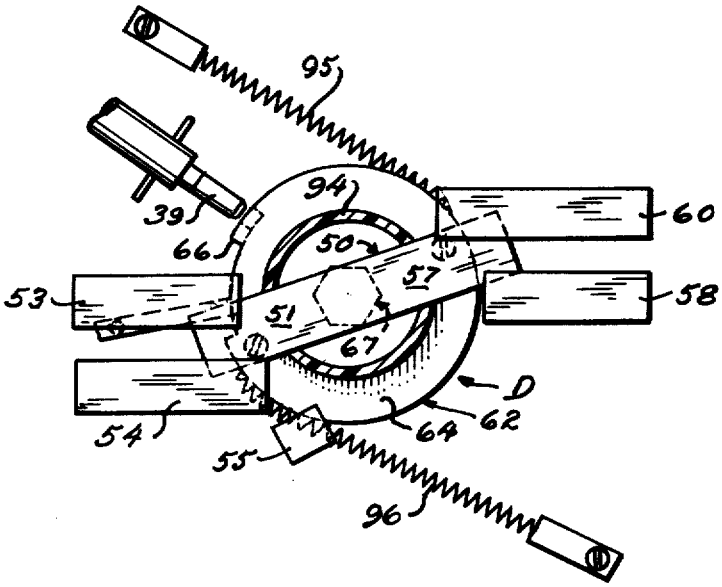
FIG. 6 is a somewhat diagrammatic view taken substantially along the line 6—6 of FIG. 4.
Figure 5:
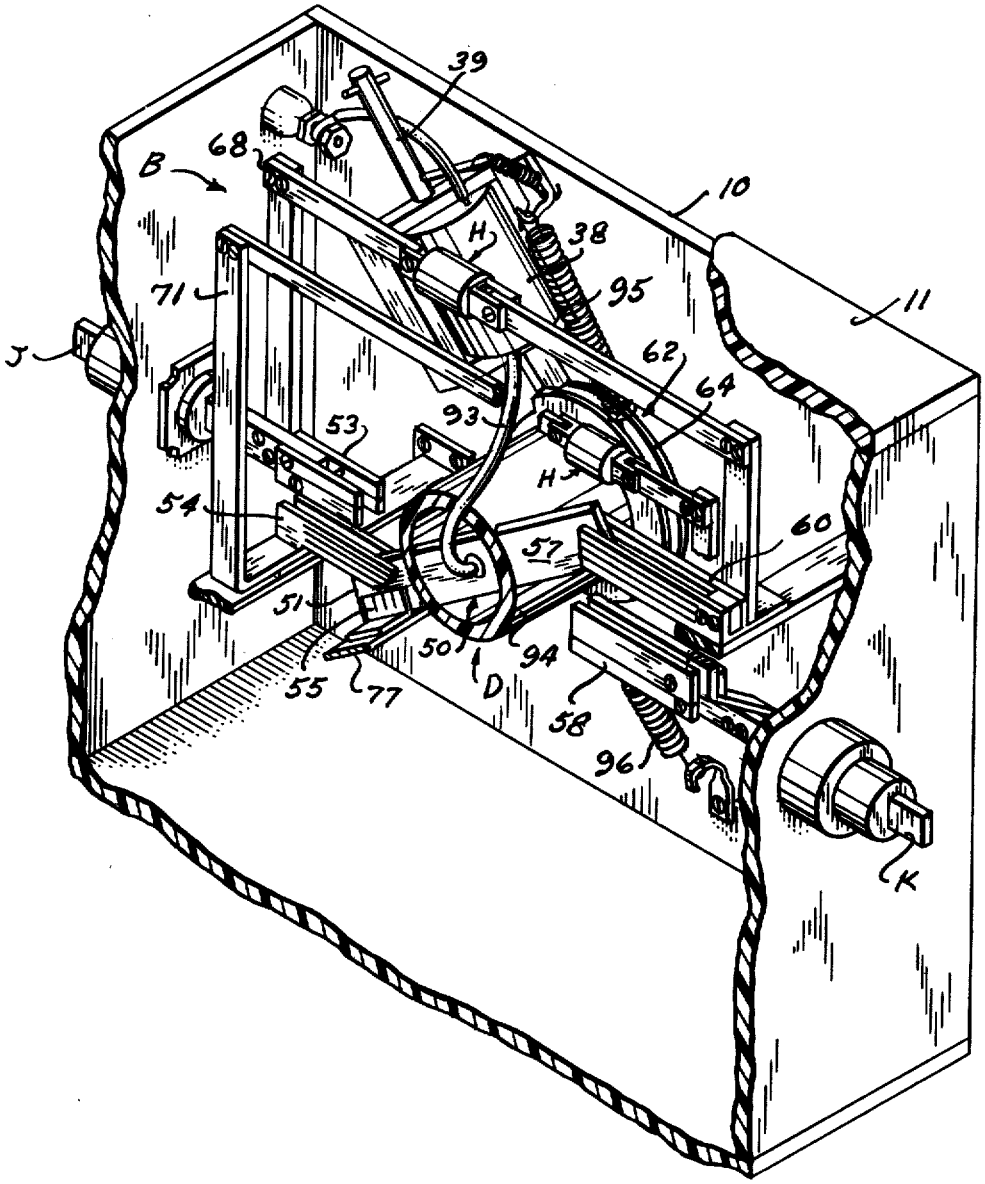
FIG. 5 is a fragmentary perspective view of the top side of the switch of FIG. 4.

As previously noted, FIG. 2 is a schematic of one phase of the embodiment as shown in FIGS. 4–6. Accordingly, identical reference characters have been applied to corresponding parts of FIGS. 2 and 4–6. In view of the versatility thereof, this will likely be the preferred embodiment.

As shown in FIG. 2, switch means D of switch B may include a switch arm 50 having a switch arm contact 51 engageable with switch arm contact 53 of conductor means J and switch arm contacts 54 and 55; and a switch arm contact 57 engageable with switch arm contact 58 of conductor means K and switch arm contact 60. It is to be particularly noted that switch arm contacts 51 and 57 are preferably of a configuration so that switch arm contact 51 engages switch arm contact 54 before leaving engagement with switch arm contact 53 while, concurrently, switch arm contact 57 engages switch arm contact 60 before leaving engagement with switch arm contact 58 (as best shown in FIG. 6); and that, as in the dotted line showing of FIG. 2, and in FIG. 5, switch arm contact 51 engages both switch arm contact 54 and switch arm contact 55 when switch arm 50 is at rest with switch arm contact 57 thereof in full engagement with only switch arm contact 60, all for purposes as will be subsequently described.

Mounting means 62 is provided for supporting switch arm 50 for pivotal movement from the position thereof as shown in full lines to the position as shown in dotted lines. Mounting means 62 may include a cam plate 64, with actuating means E providing detent means engageable with cam plate 64 for maintaining switch arm 50 as a part of and for the continuity of the main circuit (the full line showing of switch arm 50), mounting means 62 acting, on release thereof from engagement with the detent means provided by actuating means E, to move switch arm 50 and the switch arm contacts 51 and 57 thereof through the previously described cycle of successive engagement with switch arm contacts 53, 54, 55, 58 and 60, breaking the normal continuity of the main circuit therethrough, to the at rest position as shown in dotted lines in FIG. 2, and as shown in FIG. 5.

As previously described in connection with the embodiment of FIG. 1, actuating means E may comprise a solenoid 38 having a plunger 39. As shown in dotted lines in FIG. 6, plunger 39 is positioned, on depression thereof, to engage stop 66 of cam plate 64 in providing detent means for maintaining switch arm 50 as a part of and for the continuity of the main circuit.

Also, as previously described in connection with the embodiment of FIG. 1, and as best shown in FIG. 5, plunger 39 may be sufficiently elongate so that, in addition to being electrically operable, plunger 39 thereof may be manually retracted from engagement with stop means 66 of cam plate 64 for release of switch arm 50.

Further, as best shown in FIG. 4, mounting means 62 may be provided with manually operable switch arm reset means 67 for movement from the dotted line showing thereof in FIG. 2 to the full line showing thereof.

Here again, as previously described in connection with the embodiment of FIG. 1, sensor means F may comprise any conventional detection system for sensing low current arcing faults.

Alternate circuit means G of switch B preferably includes conductor means 68 having fuse means H in the circuit thereof, having a terminal 69 attached to conductor means J, and thereby being engageable in circuit with switch arm 50 when switch arm 50 forms a part of the main circuit, and another terminal 70 attached to switch arm contact 60, and thereby being engageable in circuit with switch arm 50 when switch arm 50 forms a part of the main circuit with switch arm contact 51 thereof bridging between switch arm contacts 53 and 54 and switch arm contact 57 bridging between switch arm contacts 58 and 60; and conductor means 71 having a terminal 72 attached to conductor means K, and thereby being engageable in circuit with switch arm 50 when switch arm 50 forms a part of the main circuit, and another terminal 73 attached to switch arm contact 54, and thereby being engageable in circuit with switch arm 50 when switch arm 50 forms a part of the main circuit with switch arm contact 51 thereof bridging between switch arm contacts 53 and 54 and switch arm contact 57 bridging between switch arm contacts 58 and 60.

The full line showing of alternate circuit means G is such as to provide protection for the line side of switch B. As shown, conductor means 71 may have a pair of spaced apart intermediate terminals 74 and 75 from between which conductor means 76 may be removed and, as shown in dotted lines, fuse means H inserted therebetween, providing a switch that may be used as a network isolating switch and for protecting both the line side and the load side of the main circuit.

As shown, alternate circuit means G is in parallel with the main circuit when switch arm contact 51 of switch arm 50 bridges between switch arm contacts 53 and 54 and switch arm contact 57 thereof bridges between switch arm contacts 58 and 60.

As previously described in connection with the embodiment of FIG. 1, each fuse means H may comprise a high capacity fuse.

Conductor means 77 interconnects switch arm contact 55 to conductor means L, thereby providing a solid bolted fault of switch means D, when switch arm contact 51 thereof engages switch arm contact 55.

In operation, switch means D is operable as a part of and for the normal continuity of the main circuit, as shown in heavy lines. When sensor F senses a low current arcing fault in the device to be protected, solenoid 38 is operated whereby to retract plunger 39 from engagement with stop 66 of cam plate 64, mounting means 62 moving switch arm 50 through successive engagement of switch arm contact 51 thereof with switch arm contacts 53, 54 and 55 and switch arm contact 57 thereof to successive engagement with switch arm contacts 58 and 60, as previously described. It is to be noted that, if alternate circuit means G was not operable to be in parallel with the main circuit before moving out of and breaking the normal continuity of the main circuit, appreciable arcing would occur as switch arm contacts 51 and 57 leave respective engagement with switch arm contacts 53 and 58, which feature is an important aspect of this invention, as was previously described in connection with the embodiment of FIG. 1.

When switch arm contact 51 of switch arm 50 bridges between switch arm contacts 54 and 55, with switch arm contact 57 thereof in full engagement with only switch arm contact 60, as shown in dotted lines, a solid bolted fault is provided which short circuits alternate circuit means G, clears fuse means H thereof, and thereby interrupts the main circuit.

SCHEMATIC OF FIG. 3

Switch means D of switch C may include a switch arm 80 having a switch arm contact 81 engageable with switch arm contact 83 of conductor means J and with switch arm contact 85. Mounting means 84 thereof may be identical to that of mounting means 35 of the embodiment of FIG. 1 for maintaining switch arm 80 as a part of and for the continuity of the main circuit (the full line showing of switch arm 80), and for breaking continuity of the main circuit therethrough, and movement thereof to engage switch arm contact 85 (the dotted line showing of switch arm 80).

Actuating means E of this embodiment may also be identical to that of the embodiment of FIG. 1, as may sensor means F thereof.

Alternate circuit means G is of the type for protecting only the line side of the main circuit, and preferably includes conductor means 86 having fuse means H in the circuit thereof, one terminal 87 thereof attached to conductor means J, and thereby being engageable in circuit with switch arm 80 when switch arm 80 forms a part of the main circuit, and another terminal 88 attached to and thereby engageable with switch arm 80. Alternate circuit means G is thus in parallel with the main circuit.

As previously described in connection with the embodiment of FIG. 1, fuse means H may comprise a high capacity fuse.

Conductor means 90 interconnects switch arm contact 85 to conductor means L, thereby providing a solid bolted fault of switch means D when switch arm contact 81 thereof engages switch arm contact 85.

In operation, switch means D is operable as a part of and for the normal continuity of the main circuit, as shown in heavy lines. When sensor F senses a low current arcing fault in the device to be protected, solenoid 38 and mounting means 35 act in the same manner as previously described in connection with the embodiment of FIG. 1 to release switch arm contact 81 of switch arm 80 from engagement with switch arm contact 85, as shown in dotted lines, providing a solid bolted fault which short circuits alternate circuit means G, clears fuse means H, and thereby interrupts the main circuit.

Here again, alternate circuit means G is in parallel with the main circuit, for the same purposes as previously described in connection with the embodiment of FIG. 1.

FIGS. 4–6

As previously noted, FIGS. 4–6 comprise a mechanical showing of the embodiment of FIG. 2 as it may be used for a three-phase circuit. Such is illustrative of the fact that my fused short circuit and grounding switch is applicable for use on any main circuit, regardless of how many phases the same may have.

As shown, each switch arm 50 thereof may comprise an elongated switch blade, one side of which comprises switch arm contact 51 and the other side of which comprises switch arm contact 57. A conductor 93 may be attached to switch arm 50 for energizing solenoid 38.

Mounting means 62 thereof may include an elongated tubular non-conductor 94 which is rotatably mounted within housing 10. Cam plate 64 may be mounted on tubular member 94, mounting means 62 thereof including spring means 95 and 96 which is operable, on withdrawal of plunger 39 from abutment with stop 66 of cam plate 64, to rotate tubular member 94 for moving switch arm contacts 51 and 57 of each switch arm 50 thereof through the previously described cycle of successive respective engagement with switch arm contacts 53, 54, 55, 58 and 60.

Each conductor means 68 thereof may comprise a bus bar interconnected at one terminal end thereof to conductor means J and interconnected at the other terminal end thereof to switch arm contact 60. Each conductor means 71 thereof may comprise a bus bar interconnected at one terminal end thereof to switch arm contact 54 and interconnected at the other terminal end thereof to conductor means K.

In FIG. 5, switch means B is shown with each switch arm 50 thereof disposed as a part of and for normal continuity of the main circuit of each phase; in FIG. 4, each switch arm 50 thereof is disposed to bridge switch arm contacts 51, 54, 58 and 60; and in FIG. 6, each switch arm 50 thereof is disposed to bridge switch arm contacts 54 and 55 and in engagement with switch arm contact 60.

Conductor means 77 may comprise a bus bar interconnected to conductor means J and on which switch arm contacts 55 are mounted.

Plunger 39 of solenoid 38 may be of sufficient length to extend exteriorly through access door 11, for manual retraction of plunger 39 from engagement with stop 66 of cam plate 64 without opening door 11.

Tubular member 94 may have a faceted head 99 extending exteriorly of housing 10, for manual rotation of tubular member 94 in resetting switch arms 50 thereof as a part of and for normal continuity of the main circuit of each phase without opening door 11 for access thereto.

Various changes may be made in the forms of the invention as herein shown and described without departing from the spirit of the invention or the scope of the following claims.

I claim:

1. A fused short circuit and grounding switch for interconnection in a main circuit, said switch having switch means operable in one position thereof as a part of the normal continuity of said main circuit and operable in another position to break continuity therewith as a part of said main circuit and to provide a solid bolted fault, and including alternate circuit means interconnected to and operable to be in parallel with said switch means in said one position thereof as a part of the normal continuity of said main circuit and including fuse means, said switch being operable to short circuit said alternate circuit and clear said fuse means thereof and to thereby interrupt said main circuit on operation of said switch means to the position thereof providing a solid bolted fault.

2. A fused short circuit and grounding switch as specified in claim 1 wherein one terminal of said alternate circuit is attached to a conductor of said main circuit at the side of said switch interconnectable to the line side of said main circuit and another terminal thereof is interconnected to said switch means, said fuse means being positioned in said alternate circuit interjacent said first and second mentioned terminal.

3. A fused short circuit and grounding switch as specified in claim 1 and for interconnection in a main circuit wherein feed to said switch through said main circuit may be in either direction therethrough, a terminal of said alternate circuit is attached to a conductor of said main circuit at each side of said switch interconnectable to said main circuit and an intermediate terminal thereof is interconnected to said switch means, and a fuse means is positioned in said alternate circuit interjacent said first mentioned terminal and said intermediate terminal and interjacent said second mentioned terminal and said intermediate terminal.

4. A fused short circuit and grounding switch as specified in either of claims 1, 2, or 3 wherein said alternate circuit is open at a first position of said switch means in said one position thereof, said switch means being operable to close said alternate circuit on operation thereof to the position thereof providing a solid bolted fault.

5. A fused short circuit and grounding switch as specified in claim 4 wherein said switch means includes switch arm means operable in a first position to provide a first position of said switch means in said one position thereof and in which juxtaposition said alternate circuit means is open; operable in an intermediate position as a part of the continuity of said main circuit and closing said alternate circuit means to be in parallel with said switch means; and operable to a third position to break continuity therewith as a part of said main circuit while maintaining continuity therewith as a part of said alternate circuit means and providing a solid bolted fault therefor.

6. A fused short circuit and grounding switch as specified in either of claims 1, 2, or 3 wherein said switch means is operable manually.

7. A fused short circuit and grounding switch as specified in either of claims 1, 2, or 3 wherein said switch includes actuating means for operation of said switch means and sensor means interconnected thereto for operation of said actuating means, said sensor means being positionable remote from said switch at a location to be protected by said switch and being operable to sense a condition of such protected area warranting interruption of said main circuit.

8. A fused short circuit and grounding switch as specified in either of claims 1, 2, or 3 wherein said alternate circuit is open at a first position of said switch means in said one position thereof, said switch means being operable to close said alternate circuit on operation thereof to the position thereof providing a solid bolted fault, and said switch means is operable manually.

9. A fused short circuit and grounding switch as specified in either of claims 1, 2, or 3 wherein said alternate circuit is open at a first position of said switch means in said one position thereof, said switch means being operable to close said alternate circuit on operation thereof to the position thereof providing a solid bolted fault, said switch means includes actuating means for operation of said switch means and sensor means interconnected thereto for operation of said actuating means, said sensor means being positionable remote from said switch at a location to be protected thereby and being operable to sense a condition of such protected area warranting interruption of said main circuit.

10. A fused short circuit and grounding switch as specified in claim 9 wherein said switch means includes switch arm means operable in a first position to provide a first position of said switch means in said one position thereof and in which juxtaposition said alternate circuit means is open; operable in an intermediate position as a part of the continuity of said main circuit and closing said alternate circuit means to be in parallel with said switch means; and operable to a third position to break continuity therewith as a part of said main circuit while maintaining continuity therewith as a part of said alternate circuit means and providing a solid bolted fault therefor.

11. A fused short circuit and grounding switch for interconnection in a main circuit to isolate one side of a main circuit from another side thereof, as by way of isolating the line phase conductors of a circuit from the load phase conductors thereof, and in isolating one part of a network main from another part thereof, said switch including switch means having a movable switch arm and at least first and second switch arm contacts, one said contacts including conductor means for interconnection to one side of a main circuit conductor and the other of said contacts including conductor means for interconnection with a ground, conductor means operably engageable with said switch arm and interconnectable to the other side of the main circuit conductor, said switch arm being operable in a first position thereof to engage said one said contacts for continuity of the main circuit from said one said contacts and through said switch arm to said conductor means operably engageable therewith, an alternate circuit having fuse means therein, one terminal of said alternate circuit being attached to said conductor means of said one said contacts and another terminal thereof being operably engageable with said switch arm, said switch arm being movable from said first position thereof to a second position out of engagement with said one said contacts and to engage said other of said contacts for continuity of said alternate circuit from said another terminal operably engageable with said switch arm and through said switch arm to said other of said contacts to short circuit said alternate circuit and provide a solid bolted fault to clear said fuse means and interrupt said main circuit, and actuating means for movement of said switch arm to said first and second positions thereof.

12. A fused short circuit and grounding switch as specified in claim 11 wherein said one said contacts comprises a first contact and said other of said contacts comprises a second contact, and wherein said switch means includes third and fourth contacts, said third contact including said conductor means interconnectable to said other side of the main circuit conductor and said another terminal of said alternate circuit is interconnected to said fourth contact.

13. A fused short circuit and grounding switch as specified in claim 12 wherein said alternate circuit includes a second segment having fuse means therein, one terminal of said second segment being interconnected to said fourth contact and the other terminal thereof being interconnected to said conductor means of said third contact.

14. A fused short circuit and grounding switch as specified in claim 12 wherein said switch means includes a second alternate circuit having fuse means therein, and said switch includes a fifth contact means, one terminal of said second alternate circuit being interconnected to said fifth contact and the other terminal thereof being interconnected to said conductor means interconnectable to said the other side of the main circuit conductor, said switch arm including means operably engageable with said fifth contact in said second position thereof for continuity of said second alternate circuit from said fifth contact to said second contact to short circuit said second alternate circuit and provide a solid bolted fault to clear said fuse means thereof.

15. A fused short circuit and grounding switch as specified in claim 14 wherein said switch arm is operable to a position intermediate said first and second position thereof in continuity with said main circuit and said alternate circuit means; and wherein in said second position thereof said switch arm is juxtaposed to break continuity therewith as a part of said main circuit while maintaining continuity therewith as a part of said alternate circuit means and providing a solid bolted fault therefor.

16. A fused short circuit and grounding switch as specified in claim 15 wherein said actuating means includes detent means for maintaining said switch arm in said first position thereof, means for moving said switch arm to said intermediate and then said second position thereof on release of said detent means, and means to reset said switch arm from said second to said first position thereof; and wherein said switch includes sensor means operably interconnected to said detent means for release thereof, said sensor means being positionable remote from said switch at a location to be protected by said switch and being operable to sense a condition of such protected area warranting interruption of said main circuit.

17. A fused short circuit and grounding switch as specified in either of claims 11, 12, 13, or 14 wherein said actuating means includes detent means for maintaining said switch arm in said first position thereof, means for moving said switch arm to said second position thereof on release of said detent means, and means to reset said switch arm from said second to said first position thereof.

18. A fused short circuit and grounding switch as specified in claim 17 wherein said means for moving said switch arm to said second position thereof comprises spring means and said means to reset said switch arm from said second to said first position thereof is operable manually.

19. A fused short circuit and grounding switch as specified in claim 17 wherein said switch includes sensor means operably interconnected to said detent means for release thereof, said sensor means being positionable remote from said switch at a location to be protected by said switch and being operable to sense a condition of such protected area warranting interruption of said main circuit.

20. A fused short circuit and grounding switch as specified in claim 9 wherein said detent means includes solenoid means for release thereof.

21. A fused short circuit and grounding switch as specified in claim 20 wherein said sensor means comprises a temperature sensing switch.

22. A fused short circuit and grounding switch as specified in claim 20 wherein said sensor comprises a eutectic device.

23. A fused short circuit and grounding switch as specified in claim 17 wherein said detent means is manually releasable.

* * * * *